United States Patent [19]

Fasullo et al.

[11] 4,145,153

[45] Mar. 20, 1979

[54] METHOD OF REPLACING A ROADWAY

[75] Inventors: Eugene J. Fasullo, Tuxedo; Daniel M. Hahn, Blauvelt, both of N.Y.

[73] Assignee: The Port Authority of New York and New Jersey, New York, N.Y.

[21] Appl. No.: 888,959

[22] Filed: Mar. 22, 1978

[51] Int. Cl.[2] ..... E01C 21/00

[52] U.S. Cl. ..... 404/73; 404/34; 404/70

[58] Field of Search ..... 404/75, 72, 1, 35, 17; 14/1, 69.5, 72.5, 73; 299/36, 39

[56] References Cited

U.S. PATENT DOCUMENTS

| | | | |
|---|---|---|---|
| 1,553,845 | 9/1925 | Bardol | 299/39 |
| 1,848,582 | 3/1932 | Strauss | 52/478 |
| 2,388,461 | 11/1945 | Baker | 299/36 |
| 2,426,688 | 9/1947 | Higgs | 299/36 X |
| 2,502,043 | 3/1950 | Howard | 299/39 |
| 3,066,771 | 12/1962 | Wolchuk | 52/478 |
| 3,103,025 | 9/1963 | Gassner | 14/1 |
| 3,213,768 | 10/1965 | Jensen | 404/43 |
| 3,302,361 | 2/1967 | Qudheusden | 52/618 |
| 3,315,578 | 4/1967 | Wesch | 404/73 |
| 3,366,020 | 1/1968 | Reinitzhuber | 404/1 |
| 3,426,659 | 2/1969 | Clarke | 404/83 |
| 3,721,470 | 3/1973 | Crispino | 299/39 |
| 3,803,777 | 4/1974 | Stewart | 404/35 X |
| 3,811,147 | 5/1974 | Dix | 404/1 |
| 3,915,582 | 10/1975 | Clarke | 404/75 |

*Primary Examiner*—Nile C. Byers, Jr.
*Attorney, Agent, or Firm*—Lee C. Robinson, Jr.

[57] ABSTRACT

A method of replacing an existing roadway on structure in which at least one of the lanes of the roadway is cut into rectilinear sections during a first nonpeak traffic period. The sections are left in place, and temporary traffic bearing members are positioned over the cuts to permit the flow of traffic over all of the lanes of the roadway during an ensuing peak traffic period. Orthotropic roadway modules are preformed and paved at a factory or other remote location, and each of these modules has a width equal to that of the one lane. During a second nonpeak traffic period one or more of the modules is transported to the site, the traffic bearing members and the rectilinear sections are removed and the module is connected in place. The foregoing steps are repeated during successive traffic periods until the entire roadway has been replaced.

11 Claims, 11 Drawing Figures

FIG. 4
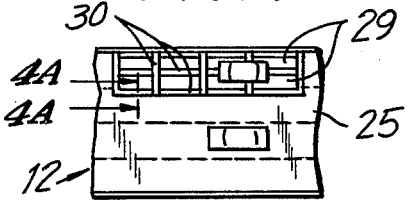
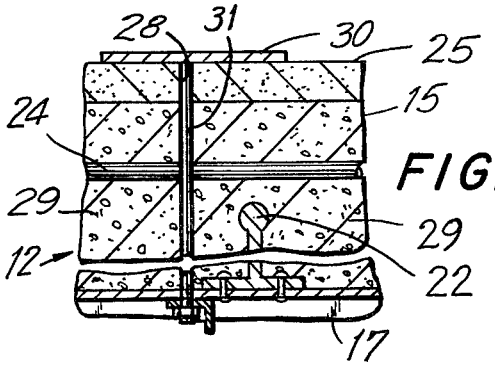
FIG. 4A
FIG. 5
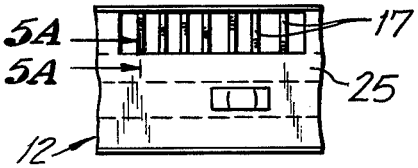
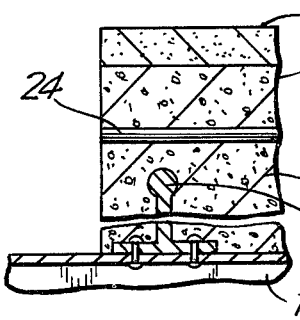
FIG. 5A
FIG. 6
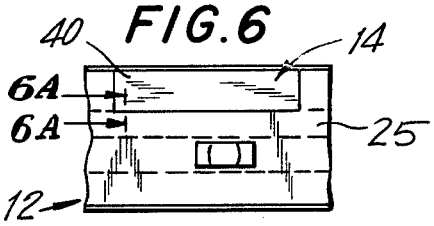
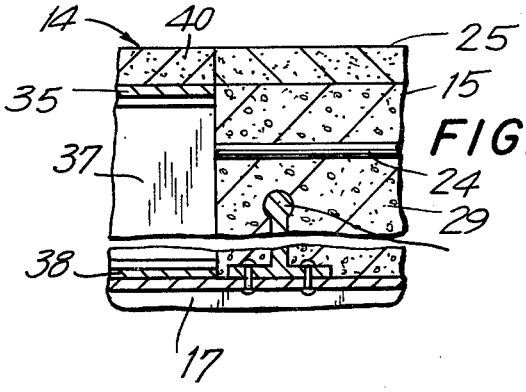
FIG. 6A
FIG. 7
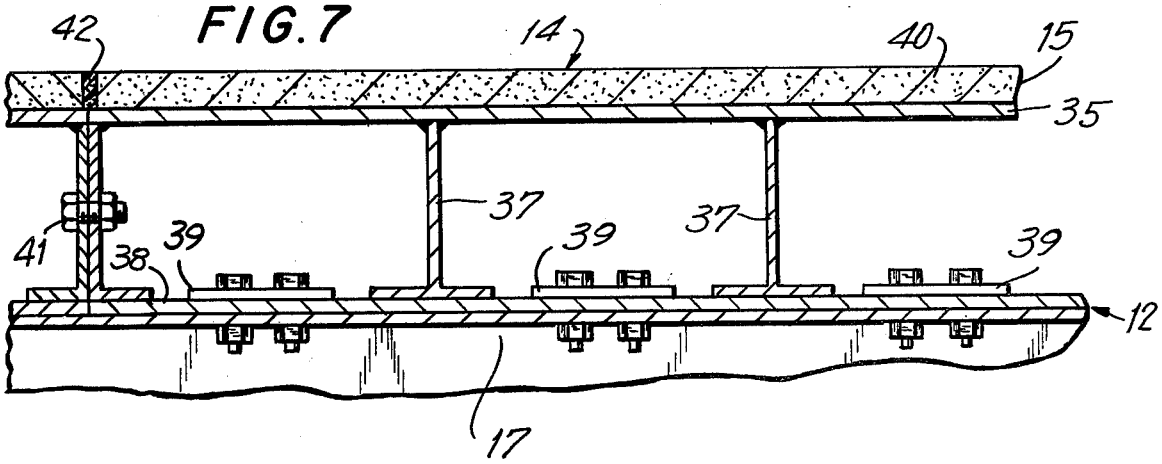

METHOD OF REPLACING A ROADWAY

BACKGROUND OF THE INVENTION

This invention relates to roadway construction and more particularly to a method of replacing and existing roadway.

The present invention, while of general application, is particularly well suited for the replacement of bridge decks and other restricted roadways where interruptions in the flow of traffic must be maintained at a minimum. After periods of heavy use even the most carefully constructed roadways begin to show signs of deterioration, including defects such as spalling, scaling and the development of cracks as the roadway expands and contracts in response to temperature changes and varying moisture conditions. To repair these various defects in accordance with conventional techniques, the deteriorated portion of the roadway is removed, the roadway is patched with concrete, epoxy or other patching material and the surface is repaved. Depending upon the amount of deterioration, the time needed to complete the necessary repairs can extend into weeks and even months before the surface is restored. In addition, the deterioration of the roadway accelerates with the passage of time, and eventually a condition is reached where conventional repairs are insufficient and the entire roadway must be replaced.

Heretofore, methods of replacing roadways have exhibited several disadvantages. In cases in which a settable material such as concrete or epoxy was applied to the damaged areas, for example, the roadway was unusable not only during construction but also during the period required for the material to cure sufficiently to support traffic. In many systems of the type previously employed it was necessary to resurface the roadway after its structural integrity has been restored, and the attendant heavy paving equipment and additional curing time further impeded the flow of traffic during the replacement process. These difficulties were of special moment for roadways having heavy peak traffic periods, and in some cases temporary by-pass roadways or bridges were constructed to maintain vehicular flow primarily during these periods.

SUMMARY

One general object of this invention, therefore, is to provide a new and improved method of replacing an existing roadway.

More specifically, it is an object of the invention to provide such a method in which interruptions in the flow of traffic are maintained at a minimum.

Another object of the invention is to provide a method of the character indicated in which the amount of onsite construction time is substantially reduced.

Still another object of the invention is to provide a novel method for replacing an existing roadway that is economical and thoroughly reliable in operation.

In accordance with an illustrative embodiment of the invention, at least one of the lanes of the roadway to be replaced is cut into rectilinear sections, such that the resulting cuts extend in directions parallel and perpendicular to the roadway. At a later point in time, the sections are removed and are replaced with a metallic rectangular roadway module of orthotropic construction. The cutting and replacement steps are repeated to replace the entire roadway in a manner such that at least one lane is open to traffic at all times.

In accordance with one feature of the invention, the cutting of the roadway is performed at night or other nonpeak traffic period, but the cut sections are left in place and used to maintain traffic flow until a subsequent nonpeak traffic period. The arrangement is such that there is little or no restriction on the flow of traffic except during the time that the roadway is undergoing minimum usage.

In accordance with another feature of the invention, in several particularly important embodiments, during normal working hours the orthotropic roadway module is preassembled at a factory or other remote location and is provided with a prepaved traffic bearing surface. During a nonpeak traffic period the module is transported to the site and substituted for the previously cut sections. The amount of on-site construction is maintained at a minimum, with the result that the roadway may be quickly and easily replaced in a rapid and straight-forward manner.

In accordance with a further feature of several good embodiments of the invention, the width of the orthotropic module is equal to that of one of the lanes of traffic, and traffic flow is maintained in another lane of the roadway as the module is set in place. As soon as the module is inserted and connected to the adjacent portion of the roadway, the entire roadway may be opened to traffic.

The present invention, as well as further objects and advantages thereof, will be understood more clearly and fully from the following description of a preferred embodiment, when read with reference to the accompanying drawings.

BRIEF DESCRIPTION OF THE DRAWINGS

FIG. 4 is a fragmentary plan view of the portion of the roadway shown in FIG. 3 but illustrating temporary traffic bearing members which are placed over the cuts during the nonpeak traffic period.

FIG. 4A is an enlarged sectional view taken along the line 4A—4A in FIG. 4.

FIG. 5 is a fragmentary plan view of the portion of the roadway shown in FIG. 3 following the removal of the sections and the temporary traffic bearing members during a subsequent nonpeak traffic period.

FIG. 5A is an enlarged sectional view taken along the line 5A—5A in FIG. 5.

FIG. 6 is a fragmentary plan view of the portion of the roadway shown in FIG. 3 after the insertion of a performed roadway module during the subsequent nonpeak traffic period.

FIG. 6A is an enlarged sectional view taken along the line 6A—6A in FIG. 6.

FIG. 7 is an enlarged fragmentary sectional view of the preformed module for the roadway.

DESCRIPTION OF A PREFERRED EMBODIMENT

Figure 1:
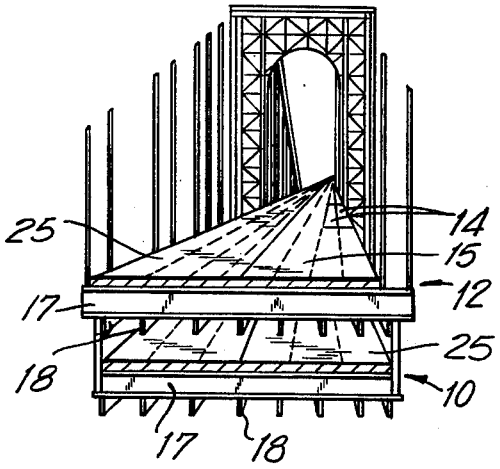
FIG. 1 is a perspective view of a bridge having a roadway constructed in accordance with the method of an illustrative embodiment of the invention.

Referring to FIG. 1 of the drawings, there is shown a typical section of a fourteen lane bridge having a six lane lower deck 10 and an eight lane upper deck 12. The lower deck 10 is in its existing deteriorated condition, while the upper deck 12 has been replaced by a series of orthotropic prefabricated steel modules 14 to form a completed roadway 15. Each of these modules has a width equal to that of a full traffic lane, commonly eleven feet, and the length of the module is several times its width and illustratively may be about sixty feet.

Figure 2:
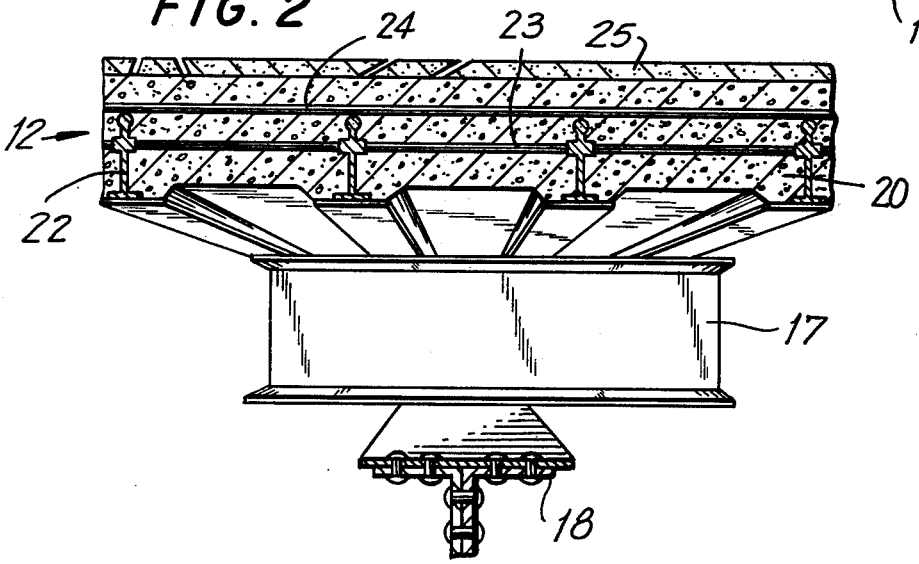
FIG. 2 is a transverse vertical sectional view of the roadway portion of the bridge prior to its replacement.

The construction of the upper deck 12 prior to the replacement of the roadway is best shown in FIG. 2. This existing construction, which is but illustrative of a wide variety of roadways with which the present invention may be employed, comprises a plurality of transverse floor beams 17 which support the deck 12 and a series of longitudinal stringers 18 beneath the floor beams. The stringers 18 are carried in known manner by main beams (not shown) extending between the suspender cables of the bridge.

The existing upper deck 12 is in the form of a thick reinforced concrete slab 20. The primary reinforcement for the slab 20 comprises a series of longitudinally extending bulb tees 22 which are riveted to the upper flanges of the floor beams 17. The bulb tees are held in the transverse direction by tie rods 23, and additional reinforcing rods 24 extend transversely through the slab above the tie rods. The slab is provided with a silica sand asphalt pavement 25 which forms the traffic bearing surface of the deck.

At least some of the upper deck lanes of the particular bridge illustrated in the drawings, the George Washington Bridge in New York City, have been in operation for over forty-six years. The bridge presently has an annual volume of approximately 78,000,000 vehicles and over the years has been subjected to repeated freeze-thaw cycles, the application of deicing salt during the winter months, and heavy abrasion due to steel studded tires, etc. Conventional repairing techniques were sufficient during the early years of the bridge's life to maintain the roadway in usable condition, but as the deterioration increased due to these factors it became apparent that a complete rehabilitation or replacement of the roadway was necessary. The existence of spalling or potholes, scaling and gradual delamination of the concrete just above the level of the bulb tees 22 has accelerated in recent years, and yet the replacement of the existing deck with a roadway of similar construction is impractical because of the attendant interruptions in the flow of traffic.

The method of the present invention resolves these various problems and provides a contiguous replacement roadway over the entire span of the bridge deck or other road bed. In a preferred embodiment, the on-site replacement work is performed only at night or during other nonpeak traffic periods, while as much of the work as practical is done at a factory or other remote location. The nonpeak traffic periods for the bridge illustrated in the drawings, for example, extend on week nights from 8 P.M. to 6 A.M., during which all of the on-site construction is accomplished while at the same time permitting uninterrupted traffic flow over all but the lane or lanes under construction and sufficient adjacent lanes for the construction equipment. During the peak traffic periods, there is no restriction on the flow of traffic even over the lane under construction.

Figure 3:
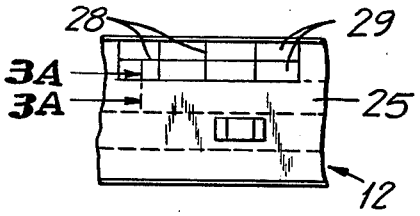
FIG. 3 is a fragmentary plan view of a portion of the roadway after it has been cut into rectilinear sections at night or other nonpeak traffic period.
Figure 3A:
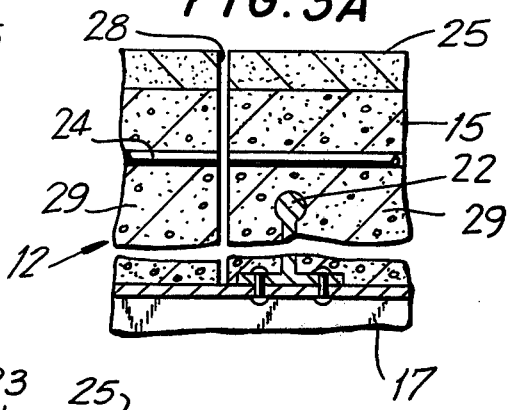
FIG. 3A is an enlarged sectional view taken along the line 3A—3A in FIG. 3.

At the beginning of the first nonpeak traffic period, a series of cuts 28 (FIG. 3) are made in the lane to be replaced. These cuts extend in directions parallel and perpendicular to the lane to form rectilinear sections 29 which illustratively may be about fifteen feet in length and five and one half feet wide. The longitudinal cuts are made with a suitable saw and extend through the concrete slab 20 between the bulb tees 32. The transverse cuts, on the other hand, are made with a jackhammer or similar tool to avoid severing the bulb tees. Although the cuts in FIG. 3 have been shown as being located in only one of the lanes, for a multiple-lane roadway such as the upper deck 12 similar cuts may be made in adjoining lanes in a single nonpeak traffic period while maintaining traffic flow in the remaining lanes.

As best seen in FIG. 4, following the formation of the cuts 28 temporary traffic bearing plates 30 are placed longitudinally and transversely over each of the cuts. The plates 30 are held in place by removable tie-downs 31 (FIG. 4A) which extend through the cuts 28 and are bolted or otherwise removably affixed to the underlying structure. The plates 30 are located in position just prior to the close of the first nonpeak traffic period, and traffic is then directed over all of the lanes of the roadway throughout the ensuing peak traffic period. The width of each plate 30 need be only sufficient to cover the cuts 28 and a sufficient portion of the adjacent roadway surface 25 to provide support.

During the second night or other nonpeak traffic period, the plates 30 are removed, and a torch or other tool is used to sever the bulb tees 22 beneath the transverse cuts 28. Through the use of suitable jacks and a crane, each of the rectilinear sections 29 of the concrete slab 20 is then lifted from the floor beams 17 and transported from the site. Throughout the second nonpeak traffic period the flow of traffic is maintained in the remaining lanes of the roadway.

During normal working hours or at other convenient times, the rectangular roadway modules 14 are preformed at a remote location in a manner that will become more fully apparent hereinafter. During the second nonpeak traffic period one or more of the preformed modules 14 is transported to the site, and each module is substituted for the removed rectilinear sections 29 in the corresponding lane. In cases in which a four lane section of a roadway is to be replaced during each nonpeak traffic period, for example, four of the modules 14 are arranged in side by side relationship with each other on the floor beams 17 or other existing roadbed. The four modules are bolted or welded together along their longitudinal joints and are also bolted or welded to the upper flanges of the floor beams 17. In cases in which the roadway is subject to expansion or contraction conditions due to variations in temperature, for example, each group of modules is completely isolated from the adjacent modules through the use of preformed neoprene compression seals of conventional construction. The modules are transported to the site in a prepaved condition, with the result that the only surface work needed at the site itself is to apply a coal tar epoxy mortar or other suitable sealant to the joints between adjacent modules. Should some unavoidable interruption take place which prevents the installation of all of the scheduled modules during the second nonpeak traffic period, one or more temporary modules may be inserted in the opening until the next available nonpeak period.

At the end of the second nonpeak traffic period, the entire roadway is opened to traffic, and traffic flows uniformly over the now completed replacement section. Successive sections are replaced during the succeeding nonpeak traffic periods until the entire lane or lanes is complete. Thereafter, the foregoing steps are repeated during subsequent traffic periods to replace the remaining lanes of the roadway.

Each of the rectangular roadway modules 14 is of prepaved orthotropic construction and is fabricated at a remote location from structural steel or similar metallic material. As best illustrated in FIG. 7, each module 14 comprises a rectangular deck plate 35 which is welded to longitudinally extending stiffening ribs 37. Strap plates 38 are welded to the lower flanges of the ribs 37 at the locations of the existing floor beams 17. The strap plates 38 are provided with pairs of oversized holes which accommodate the bolts used to secure the modules 14 to the floor beams 17 at the site. To insure full bearing of each module on the beams, plate washers 39 are used over the holes.

A traffic bearing surface 40, such as asphaltic concrete pavement, is applied to the deck plate 35 at the remote location such that each completed module comprises a finished section of the replacement roadway. To facilitate the prefabrication of this surface, a group of the modules 14 may be temporarily fastened together at the remote location, as by bolts 41, and then paved as a unit. The pavement is saw cut along the joints between the individual modules, the modules are unbolted, and they are then stored for eventual transportation to the site. When the individual modules are installed on the roadway, they are again bolted together, and the joints are filled with a suitable coal tar epoxy mortar 42.

When located in position on the floor beams 17, each of the strap plates 38 on the modules 14 serves as a cover plate for three adjacent beams and is structurally integrated therewith. To provide increased corrosion protection of the interface between the strap plates and the floor beams, the upper flanges of the beams may be coated with epoxy paint prior to the installation of the modules.

One of the additional advantages of the use of orthotropic modules for the roadway is that there is a significant reduction in stress levels in the primary structural elements of the bridge. The reduction in the overall weight of the roadway and the unique way in which it is assembled and installed results in a lower static loading and hence provides an overall reserve loading capacity. The dynamic vehicular loading and the aerodynamic response characteristics of the roadway also are improved over the existing structure.

Although the present invention has been illustrated and described as having particular utility in the replacement of one or more decks of a suspension bridge, it may also be used with good effect to replace other forms of roadways. Depending on the type and condition of the existing roadway, the individual preformed and prepaved modules may be connected to the roadbed or to still intact structural elements of the roadway itself. Various other applications for the method of the invention will suggest themselves to those skilled in the art upon a perusal of the foregoing disclosure.

The terms and expressions which have been employed are used as terms of description and not of limitation, and there is no intention, in the use of such terms and expressions, of excluding any equivalents of the features shown and described or portions thereof, it being recognized that various modifications are possible within the spirit and scope of the invention.

What is claimed is:

1. A method of replacing a roadway, comprising the steps of:

cutting narrow slits in a portion of the roadway during a first nonpeak traffic period, to form a plurality of sections in said roadway while leaving the sections in place;

preforming at a remote location an orthotropic roadway module;

transporting the preformed module to said roadway during a second nonpeak traffic period;

removing the cut sections from said roadway during said second nonpeak traffic period;

substituting the preformed module for the removed sections during said second nonpeak traffic period; and connecting the substituted module to an adjacent portion of the roadway during said second nonpeak traffic period.

2. A method of replacing a roadway, comprising the steps of:

cutting narrow slits in a portion of the roadway during a first nonpeak traffic period, to form a plurality of sections in said roadway while leaving the sections in place;

placing temporary traffic bearing members over the slits during the first nonpeak traffic period;

preforming at a remote location an orthotropic roadway module;

transporting the preformed module to said roadway during a second nonpeak traffic period;

removing the traffic bearing members and the cut sections from said roadway during said second nonpeak traffic period;

substituting the preformed module for the removed sections during said second nonpeak traffic period; and connecting the substituted modules to an adjacent portion of the roadway during said second nonpeak traffic period.

3. A method as defined in claim 2, which further comprises the step of:

directing traffic over the cut sections and the temporary traffic bearing members between the first and second nonpeak traffic periods.

4. A method as defined in claim 2, which further comprises the steps of:

assembling a plurality of the rectangular roadway modules at the remote location;

applying a traffic bearing surface to the assembled modules at the remote location;

cutting apart the traffic bearing surface between the individual modules at the remote location; and disassembling the assembled modules at the remote location following the application of the traffic bearing surface thereto.

5. A method of replacing a roadway, comprising the steps of:

cutting a portion of the roadway into sections during a first nonpeak traffic period, to form a plurality of cuts in said roadway;

leaving the cut sections in place on said roadway for an extended period of time following said first nonpeak traffic period;

preforming at a remote location a rectangular roadway module;

applying a traffic bearing surface to the preformed roadway module at the remote location;

transporting the preformed roadway module with its traffic bearing surface to said roadway during a second nonpeak traffic period;

removing the cut sections from said roadway during said second nonpeak traffic period;

substituting the preformed module for the removed sections during said second nonpeak traffic period; and connecting the substituted module to an adjacent portion of the roadway during said second nonpeak traffic period.

6. A method of replacing an existing multiple-lane roadway, the method comprising the steps of:

cutting at least one of the lanes of the roadway into sections during a first nonpeak traffic period, to form a plurality of cuts in said one lane;

leaving the cut sections in place on said roadway for an extended period of time following said first nonpeak traffic period;

preforming at a remote location an orthotropic roadway module;

applying a traffic bearing surface to the preformed module at the remote location;

transporting the preformed roadway module with its traffic bearing surface to said one lane during a second nonpeak traffic period;

removing the cut sections from said one lane during said second nonpeak traffic period;

substituting the preformed roadway module for the removed sections during said second nonpeak traffic period; and connecting the substituted module to an adjacent portion of the roadway during said second nonpeak traffic period.

7. A method of replacing an existing multiple-lane roadway, the method comprising the steps of:

cutting narrow slits in at least one of the lanes of the roadway during a first nonpeak traffic period, to form a plurality of sections in said one lane;

placing temporary traffic bearing members over the slits in said one lane during the first nonpeak traffic period;

directing traffic over all of the lanes of the roadway during an ensuing peak traffic period;

preforming at a remote location a rectangular roadway module;

applying a traffic bearing surface to the preformed module at the remote location;

transporting the preformed roadway module with its traffic bearing surface to said one lane during a second nonpeak traffic period;

removing the traffic bearing members and the cut sections from said one lane during said second nonpeak traffic period;

substituting the preformed roadway module for the removed sections during said second nonpeak traffic period; and connecting the substituted module to an adjacent portion of the roadway during said second nonpeak traffic period.

8. A method of replacing an existing multiple-lane roadway, the method comprising the steps of:

cutting at least one of the lanes of the roadway into rectilinear sections during a first nonpeak traffic period, to form a plurality of cuts in said one lane extending in directions parallel and perpendicular thereto, the cuts in at least one of said directions being formed by sawing narrow slits in said roadway;

placing temporary traffic bearing members over the cuts in said one lane during the first nonpeak traffic period;

directing traffic over all of the lanes of the roadway during an ensuing peak traffic period;

preforming at a remote location an orthotropic roadway module;

applying a traffic bearing surface to the preformed roadway module at the remote location;

transporting the preformed roadway module with its traffic bearing surface to said one lane during a second nonpeak traffic period;

removing the traffic bearing members and the rectilinear sections from said one lane during said second nonpeak traffic period;

substituting the preformed roadway module for the removed rectilinear sections during said second nonpeak traffic period; and connecting the substituted module to an adjacent portion of the roadway during said second nonpeak traffic period.

9. A method of replacing an existing multiple-lane roadway, the method comprising the steps of:

cutting at least one of the lanes of the roadway into rectilinear sections during a first nonpeak traffic period while maintaining traffic flow during said first period in another lane of the roadway, to form a plurality of cuts in said one lane extending in directions parallel and perpendicular thereto, the cuts in at least one of said directions being formed by sawing narrow slits in said roadway;

leaving the cut sections in place on said roadway for an extended period of time following said first nonpeak traffic period;

placing temporary traffic bearing members over the cuts in said one lane during the first nonpeak traffic period;

directing traffic over all of the lanes of the roadway during an ensuing peak traffic period;

preforming at a remote location rectangular roadway module;

applying a traffic bearing surface to the preformed roadway module at the remote location;

transporting the preformed roadway module with its traffic bearing surface to said one lane during a second nonpeak traffic period;

removing the traffic bearing members and the rectilinear sections from said one lane during said second nonpeak traffic period while maintaining the traffic flow during said second period in said other lane;

substituting the preformed roadway module for the removed rectilinear sections during said second nonpeak traffic period; and connecting the substituted module to an adjacent portion of the roadway during said second nonpeak traffic period.

10. A method as defined in claim 9, in which the roadway module is orthotropically assembled at the remote location from metallic structural components.

11. A method of replacing an existing multiple-lane roadway, the method comprising the steps of:

cutting at least one of the lanes of the roadway into rectilinear sections during a first nonpeak traffic period while maintaining traffic flow during said first period in another lane of the roadway, to form a plurality of cuts in said one lane extending in directions parallel and perpendicular thereto;

placing temporary traffic bearing members over the cuts in said one lane during the first nonpeak traffic period;

leaving the cut sections in place on said roadway for an extended period of time following said first nonpeak traffic period;

directing traffic over the cut sections during an ensuing peak traffic period;

preforming at a remote location a metallic rectangular roadway module having a width equal to that of said one lane;

applying a traffic bearing surface to the preformed roadway module at the remote location;

transporting the preformed roadway module with its traffic bearing surface to said one lane during a second nonpeak traffic period;

removing the traffic bearing members and the rectilinear sections from said one lane during said second nonpeak traffic period while maintaining traffic flow during said second period in said other lane;

substituting the preformed roadway module for the removed rectilinear sections during said second nonpeak traffic period; and connecting the substituted module to an adjacent portion of the roadway during said second nonpeak traffic period.

* * * * *